US009978229B2

(12) United States Patent
Lim et al.

(10) Patent No.: US 9,978,229 B2
(45) Date of Patent: May 22, 2018

(54) TAMPER DETECTION DEVICE AND A METHOD FOR INSTALLING THE DEVICE

(71) Applicant: Glass Security Pte Ltd, Johor (MY)

(72) Inventors: Luke Lim, Johor (MY); Boon Kiong Kok, Singapore (SG)

( * ) Notice: Subject to any disclaimer, the term of this patent is extended or adjusted under 35 U.S.C. 154(b) by 0 days. days.

(21) Appl. No.: 15/300,570

(22) PCT Filed: Mar. 31, 2015

(86) PCT No.: PCT/SG2015/000109
§ 371 (c)(1),
(2) Date: Sep. 29, 2016

(87) PCT Pub. No.: WO2015/152824
PCT Pub. Date: Oct. 8, 2015

(65) Prior Publication Data

US 2017/0323537 A1 Nov. 9, 2017

Related U.S. Application Data

(60) Provisional application No. 61/972,545, filed on Mar. 31, 2014, provisional application No. 62/097,143, filed on Dec. 29, 2014.

(51) Int. Cl.
*G08B 13/04* (2006.01)

(52) U.S. Cl.
CPC ..... *G08B 13/04* (2013.01)

(58) Field of Classification Search
CPC ..... G08B 13/04
USPC ..... 345/545.1
See application file for complete search history.

(56) References Cited

U.S. PATENT DOCUMENTS

| | | | | |
|---|---|---|---|---|
| 3,825,918 | A | 7/1974 | Laidlaw et al. | |
| 4,867,820 | A | 9/1989 | Jacobson et al. | |
| 4,928,085 | A | 5/1990 | DuRand et al. | |
| 5,318,145 | A | 6/1994 | Vollmer | |
| 7,350,615 | B2 | 4/2008 | Maeno et al. | |
| 2003/0089890 | A1* | 5/2003 | Niu | B82Y 10/00 252/500 |
| 2006/0273898 | A1 | 12/2006 | Hagiwara | |
| 2008/0030310 | A1 | 2/2008 | Okada et al. | |
| 2009/0142579 | A1* | 6/2009 | Smith | B32B 17/10 428/323 |

FOREIGN PATENT DOCUMENTS

| | | | |
|---|---|---|---|
| EP | 1833030 | A1 | 12/2007 |
| GB | 262571 | A | 12/1926 |

(Continued)

OTHER PUBLICATIONS

Japan Patent Office International Search Report dated Jul. 7, 2015 in reference to co-pending International Application No. PCT/SG2015/000109 filed Mar. 31, 2015.

(Continued)

*Primary Examiner* — Kevin Kim
(74) *Attorney, Agent, or Firm* — Dinsmore & Shohl LLP

(57) ABSTRACT

There is provided a tamper detection device comprising a laminate; a contact lead attached to the laminate; and a detection module connected to the contact lead. It is advantageous that the laminate is configured to conform to an application surface, and to move the contact lead. A method of installing the device is also disclosed.

20 Claims, 5 Drawing Sheets

(56) References Cited

FOREIGN PATENT DOCUMENTS

| | | | |
|---|---|---|---|
| JP | 2004018310 | | 1/2004 |
| JP | 2005310077 | A | 11/2005 |
| JP | 2006083675 | A | 3/2006 |
| JP | 2006126903 | A | 5/2006 |
| WO | 8701228 | A1 | 2/1987 |
| WO | 2013142962 | A1 | 10/2013 |
| WO | 2015152824 | A1 | 10/2015 |

OTHER PUBLICATIONS

Japan Patent Office International Preliminary Report dated Mar. 28, 2016 in reference to co-pending International Application No. PCT/SG2015/000109 filed Mar. 31, 2015.

Partial European Search Report dated Nov. 2, 2017 for EP15773185.

* cited by examiner

TAMPER DETECTION DEVICE AND A METHOD FOR INSTALLING THE DEVICE

CROSS REFERENCE TO RELATED APPLICATIONS

This application is a national-stage entry of International Patent Application No. PCT/SG2015/000109, filed Mar. 31, 2015, which international application designates the United States and claims the benefit of U.S. Provisional Application Ser. No. 61/972,545, filed Mar. 31, 2014, and of U.S. Provisional Application Ser. No. 62/097,143, filed Dec. 29, 2014.

FIELD OF INVENTION

The present invention relates to a tamper detection device and a method for installing the device.

BACKGROUND

There are many places where detection of panel breakage is important. It should be appreciated that the panels can be made from, for example, glass, plastic, crystal, and so forth. Furthermore, the panels need not be transparent, and can also have a frosted surface. Some examples of such places include, window display areas for retail stores, windscreens/windows for vehicles, display cases at exhibitions, and so forth. The detection of panel breakage is critical to ensure that potential breaches of security can be promptly acted upon by the requisite parties.

Currently, known tamper detection devices in relation to detecting breakage in panels generally include at least one of: a first sensor to detect an acoustic and/or shock signature of the panel shattering, a second sensor to determine electrical continuity of a patterned conductive layer added on the surface of the glass, and a laminate applied to the panel surface to withstand breakage or punctures. Furthermore, there are also methods which rely on at least one of the aforementioned devices to carry out tamper detection for the panels. Unfortunately, the aforementioned devices/methods have issues which adversely affect their effectiveness in relation to tamper detection.

For example, acoustic and/or shock sensors are susceptible to false positives given the difficulty in adjusting their sensitivity. In addition, the patterned conductive layer usually does not cover an entire surface of the panel in question, and this leaves vulnerable areas on the panel where tampering can be carried out without detection. Furthermore, a laminate merely reinforces the panel it is applied to, and is incapable of detecting whether the panel has been tampered with.

It is evident that there are issues in relation to tamper detection of panels.

SUMMARY

In a first aspect, there is provided a tamper detection device comprising a laminate; a contact lead attached to the laminate; and a detection module connected to the contact lead. It is advantageous that the laminate is configured to conform to an application surface, and to move the contact lead. The device further includes an adhesive layer along a perimeter of the laminate, and there may be an opening defined within the adhesive layer which is configured to be a sealable outlet.

The laminate can be either a conductive sheet or a piezoelectric sheet. The laminate can also include an opening, the opening being configured to fit a one-way valve for passage of air.

The detection module can be wirelessly connected and can be configured to detect pressure change. The detection module includes at least one mechanism selected from, for example, strain gauge pressure sensor, optical sensor, contact-based sensor, voltage amplifier and so forth.

The tamper detection device can further include at least one motion detection sensor electrically connected to the detection module.

In another aspect, there is provided a tamper detection device comprising a laminate; and a detection module connected to the laminate via a tube, the detection module including a pressure sensor. Preferably, the laminate is configured to conform to an application surface, and to activate the detection module. The device can further include an adhesive layer along a perimeter of the laminate, and an opening defined within the adhesive layer can be configured to be a sealable outlet.

The laminate may be either a conductive sheet or a piezoelectric sheet. The laminate may include an opening, the opening being configured to fit a one-way valve for passage of air.

The tamper detection device can further include at least one motion detection sensor electrically connected to the detection module.

Furthermore, the aforementioned tamper detection devices can be installed to a panel.

In another aspect, there is provided a method for installing one of the aforementioned tamper detection devices to a panel. The method comprising applying a layer of adhesive along a perimeter of the laminate of the device; mounting the device to the panel; connecting the contact lead to the detection module; and extracting air from a closed area defined by the panel, the adhesive layer and the laminate, wherein the laminate is configured to conform to the panel, and to move the contact lead. The method may alternatively include applying a layer of adhesive along a perimeter of the panel.

Preferably, the contact lead physically touches a secondary contact of the panel after extracting the air.

The adhesive is applied either in a circular motion of concentric circles or by using an adhesive sheet with a majority of a centre portion removed.

The method may further include mounting at least one intermediate layer between the device and the panel, the at least one intermediate layer being either a laminate of the device or a porous conductive sheet.

In a further aspect, there is provided a method for installing another of the aforementioned devices to a panel. The method comprising applying a layer of adhesive along a perimeter of the panel; mounting the device to the panel; connecting the tube to the detection module and the laminate; and extracting air from a closed area defined by the panel, the adhesive layer and the laminate. Preferably, the laminate is configured to conform to the panel.

The adhesive is applied either using a circular motion of concentric circles or using an adhesive sheet with a majority of a centre portion removed.

The method can further include mounting at least one intermediate layer between the device and the panel, the at least one intermediate layer being the laminate of the device or a porous conductive sheet.

DESCRIPTION OF FIGURES

In order that the present invention may be fully understood and readily put into practical effect, there shall now be described by way of non-limitative example only preferred embodiments of the present invention, the description being with reference to the accompanying, illustrative figures.

DESCRIPTION OF PREFERRED EMBODIMENTS

Figure 1:
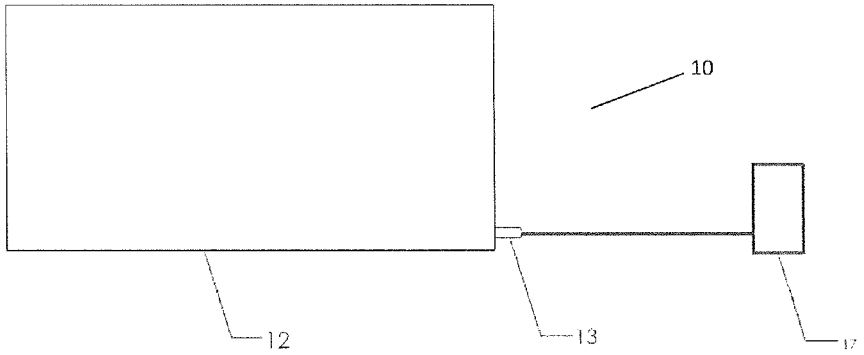
FIG. 1 show a schematic block diagram of a device of the present invention.

Referring to FIG. 1, there is shown a block diagram for a tamper detection device 10. The device 10 is used to detect breaking/tampering of a panel which the device 10 is mounted to. The tamper detection device 10 can be mounted to either a flat or a curved surface at any position/orientation. In addition, the panel which the device 10 can be mounted to can be transparent, translucent or opaque. The device 10 comprises a laminate 12. The laminate 12 is conductive and is made from a material such as, for example, Indium Tin Oxide (ITO), AZO coated polymers (for example, PVB, PVC and PVE), and so forth. Alternatively, the laminate 12 can also be a piezoelectric sheet. Furthermore, the device 10 includes a detection module 17. The detection module 17 is configured to detect only pressure change, and is unaffected by other ambient environmental effects such as sound or shock waves. The detection module 17 can be independently/externally powered and can include at least one mechanism selected from, for example, a strain gauge pressure sensor, an optical sensor (like Fiber Bragg grating), a contact-based sensor, a voltage amplifier or variants of the aforementioned. The voltage amplifier in the detection module 17 is configured to detect a voltage charge when the piezoelectric sheet undergoes a physical change.

The laminate 12 also includes a first contact lead 13. The first contact lead 13 is attached to a surface of the laminate 12 using a conductive adhesive. The detection module 17 is either electrically or wirelessly connected to the laminate 12 via the first contact lead 13. The detection module 17 can be located either within or external (as shown in FIG. 1) to the perimeter of the laminate 12.

It should be appreciated that the device 10 can be packed into a compact form factor and can be easily stored and transported.

Figure 2:
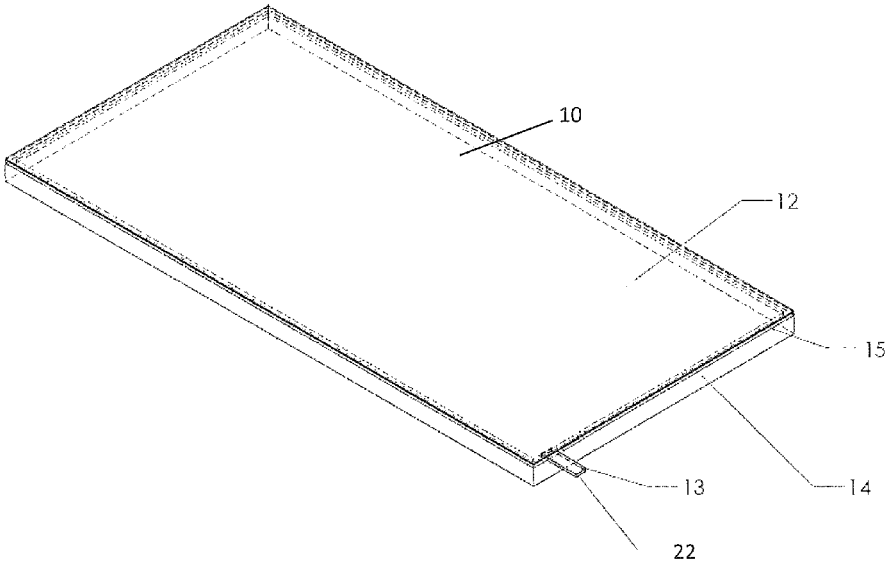
FIG. 2 shows a perspective view of the device of the present invention prior to installation to a glass panel.
Figure 3:
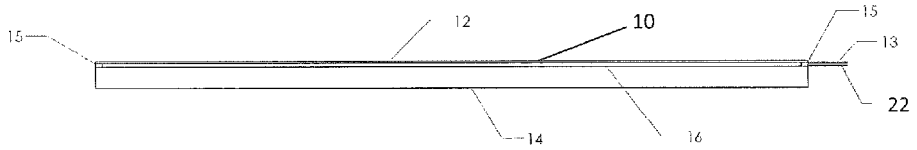
FIG. 3 shows a cross sectional view of the device of the present invention prior to installation to a glass panel.

Referring to FIGS. 2 and 3, there is shown a perspective view and a cross sectional view of the device 10 prior to installation to a glass panel 14 respectively. The glass panel 14 can be of any shape, size and need not be a flat surface. The laminate 12 is mounted to the glass panel 14 using an adhesive layer 15 applied (in a circular motion of concentric circles) along a perimeter of the laminate 12. The adhesive layer 15 can be applied by compressing a tube of adhesive, and the application in the circular motion of concentric circles is to minimise a number of voids in the adhesive layer 15 and to ensure that the adhesive layer 15 is able to provide a hermetic seal. The adhesive layer 15 can be covered by a waxed sheet to maintain adhesive properties of the adhesive layer 15. The adhesive layer 15 can be applied to either the glass panel 14 or the laminate 12. The adhesive layer 15 can be made from, for example, epoxy, cement, resin, and the like. The adhesive layer 15 acts as a spacer to maintain a pre-determined distance between the laminate 12 and the glass panel 14. However, it should be noted that once the laminate 12 is mounted, the adhesive layer 15 is able to create an air-tight seal for a closed area 16 defined by the laminate 12, the glass panel 14 and the adhesive layer 15. Alternatively, the adhesive layer 15 can also be formed using an adhesive sheet with a majority of a centre portion removed, leaving the adhesive layer 15 to form a seal.

Figure 4:
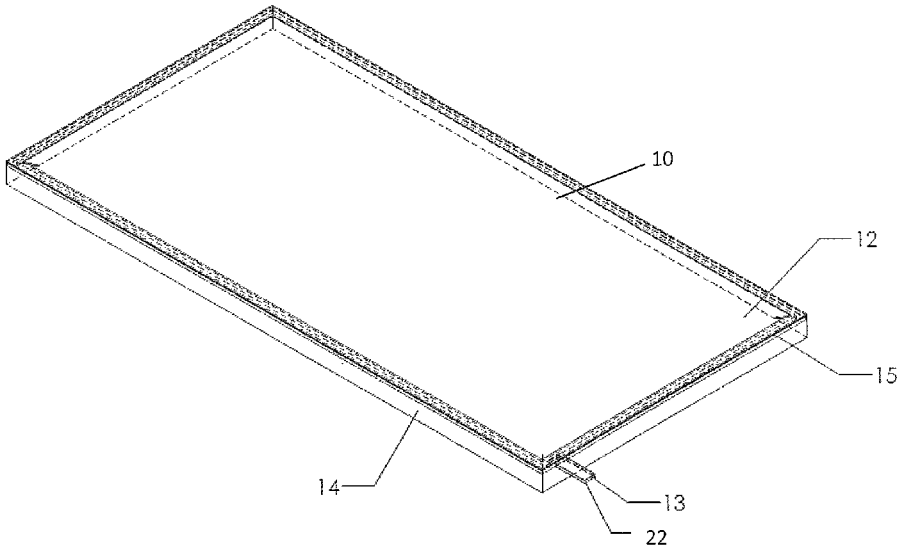
FIG. 4 shows a perspective view of the device of the present invention after installation on a glass panel.
Figure 5:
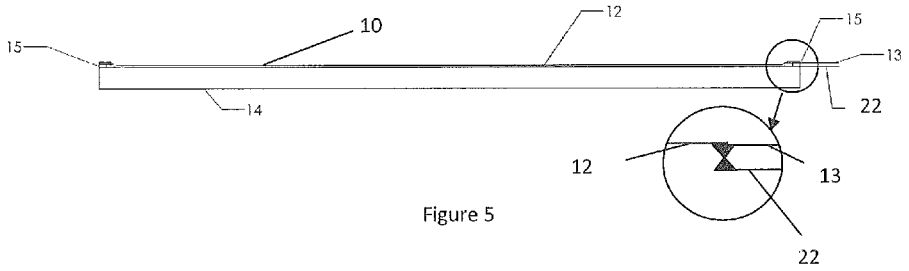
FIG. 5 shows a cross sectional view the device of the present invention after installation on a glass panel.

Air from the closed area 16 is subsequently extracted after the laminate 12 is mounted. The laminate 12 can include an opening to fit a one-way valve which is configured to let air out from the closed area 16. Alternatively, a sealable outlet can be incorporated into the adhesive layer 15 for the same purpose as the one-way valve. After air is extracted from the closed area 16, a pressure differential between the ambient environment and the closed area 16 causes the laminate 12 to experience a suction force and contact the glass panel 14. FIGS. 4 and 5 show the device 10 after extraction of the air.

The glass panel 14 is treated with a conductive material, and also includes a second contact lead 22. The second contact lead 22 can be attached to the glass panel 14 using either ultra-sonic soldering or a conductive adhesive. The second contact lead 22 is also electrically connected to the detection module 17 (not shown). The contact leads 13, 22 extend through the adhesive layer 15 to connect with laminate 12. The first contact lead 13 and the second contact lead 22 are both simultaneously connected to the detection module 17. After the air is extracted from the closed area 16, the laminate 12 contacts the glass panel 14 and the second contact lead 22 comes into contact with the first contact 13 as shown in FIG. 5. Subsequently, this forms a closed circuit with the detection module 17 (that is, electricity continuity is present). When the glass panel 14 is subject to tampering which causes, for example, cracks, breakages, and the like, the pressure differential at the closed area 16 is lost, and this causes the first contact lead 13 and the second contact lead 22 to be spaced apart, thus forming an open circuit with the detection module 17. Once the open circuit is created, the detection module 17 is configured to activate a status indicator. The status indicator can be in the form of at least one of, for example, a communications transmitter (for text message transmissions over a data/communications network), an audio transmitter (like a siren), a visual transmitter (like a beacon), or other forms of transmitters.

It should be appreciated that the first contact lead 13 and the second contact lead 22 can be omitted when a pressure sensor in detection module 17 is connected to the laminate 12 without use of any wires. In such an embodiment, the pressure sensor (or transducer) is connected to the laminate 12 using a tube, and the pressure sensor in detection module 17 is activated by a change in pressure.

Figure 6:
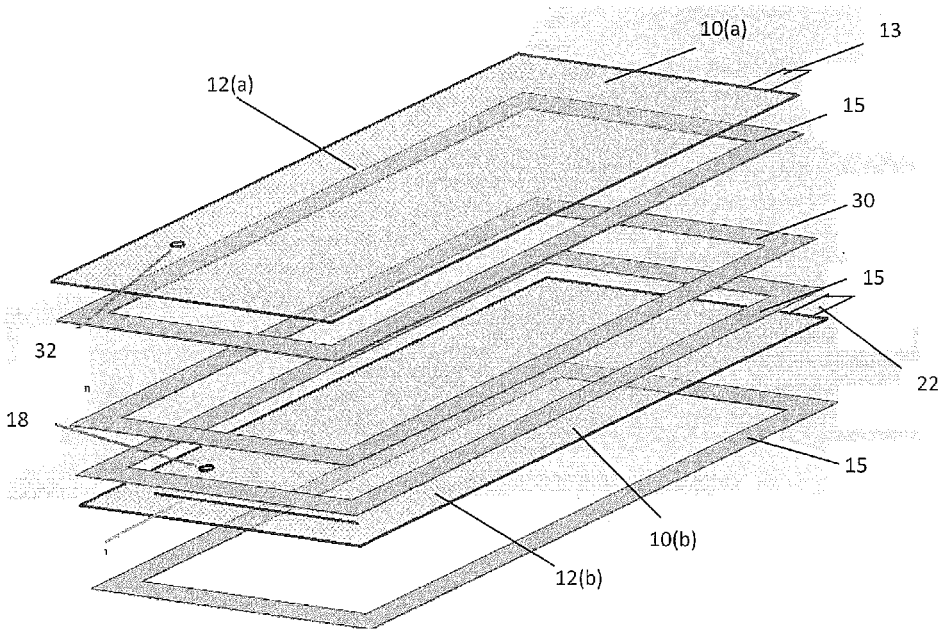
FIG. 6 shows a perspective view of a plurality of the device of the present invention prior to installation to a glass panel.

Referring to FIG. 6, there is shown a plurality of the devices 10(*a*), 10(*b*) and a spacer layer 30 (made from a porous material which allows passage of air) overlaid on each other prior to installation on the glass panel (not shown). The spacer layer 30 is necessary when an adhesive layer 15 is insufficiently thick. The plurality of devices is used with a glass panel so that the glass panel does not need to be treated with a conductive material. While only two devices are shown, there can be more layers of devices. In this application, only the topmost device 10(*a*) includes a first contact lead 13. The first contact lead 13 of the topmost device 10(*a*) is electrically connected to a detection module 17 (not shown). The detection module 17 can be located either within or external to the perimeter of the laminate 12.

The intermediate device 10(*b*) includes a venting hole(s) 18 to allow passage of air. The intermediate substrate 10(*b*) can also be replaced by an intermediate porous conductive material that negates the need for venting holes. FIG. 6 shows a multiple device 10 and spacer layer configuration. The topmost device 10(*a*) is mounted to the intermediate device 10(*b*) using the adhesive layer 15 applied (in a circular motion of concentric circles) along a perimeter of the topmost device 10(*a*). The adhesive layer 15 can be applied by compressing a tube of adhesive, and the application in the circular motion of concentric circles is to minimise a number of voids in the adhesive layer 15 and to ensure that the adhesive layer 15 is able to provide a hermetic seal. The adhesive layer 15 can be covered by a waxed sheet to maintain adhesive properties of the adhesive layer 15.

Similarly, the spacer layer 30 is mounted to the intermediate device 10(*b*) using an adhesive layer 15 applied (in a circular motion of concentric circles) along a perimeter of the spacer layer 30. In addition, the intermediate device 10(*b*) is mounted to the glass panel using an adhesive layer 15 applied (in a circular motion of concentric circles) along a perimeter of the intermediate device 10(*b*). Each adhesive layer 15 acts as a spacer to maintain a pre-determined distance between the topmost device 10(*a*), the spacer layer 30, the intermediate device 10(*b*) and the glass panel. The adhesive layers 15 are able to create an air-tight seal for a closed area defined by the topmost device 10(*a*), the glass panel and the adhesive layers 15.

Air from the closed area is subsequently extracted after the devices 10(*a*), 10(*b*) are mounted. The topmost device 10(*a*) can include an opening 32 to fit a one-way valve which is configured to let air out from the closed area. Alternatively, a sealable outlet can be incorporated into the adhesive layer 15 for the same purpose as the one-way valve. After air is extracted from the closed area, a pressure differential between the ambient environment and the closed area causes the laminates 12(*a*), 12(*b*) to experience a suction force and contact the glass panel.

A second contact lead 22 is attached to either the intermediate device 10(*b*) (as shown) or the glass panel (only after the glass panel has undergone treatment with a conductive material) using either ultra-sonic soldering or a conductive adhesive. The second contact lead 22 is also electrically connected to the detection module 17 (not shown). The first contact lead 13 and the second contact lead 22 are both simultaneously connected to the detection module 17. After the air is extracted from the closed area, the laminates 12(*a*), 12(*b*) contacts the glass panel 14 and the second contact lead 22 comes into contact with the first contact 13. Subsequently, this forms a closed circuit with the detection module 17 (that is, electricity continuity is present). When the glass panel is subject to tampering which causes, for example, cracks, breakages, and the like, the pressure differential at the closed area is lost, and this causes the first contact lead 13 and the second contact lead 22 to be spaced apart, thus forming an open circuit with the detection module 17. Once the open circuit is created, the detection module 17 is configured to activate a status indicator. The status indicator can be in the form of at least one of, for example, a communications transmitter (for text message transmissions over a data/communications network), an audio transmitter (like a siren), a visual transmitter (like a beacon), or other forms of transmitters.

It should be appreciated that the device 10 functions reliably and is resistant to false alarms as the first contact 13 and the second contact 22 do not easily break contact. Furthermore, the glass panel which the device(s) 10 is mounted on can be mounted on another panel to reinforce the other panel. Advantageously, movement of the panels (could be windows or doors) are not hampered after the panels have been reinforced. Furthermore, information regarding the tampering of panels can also be transmitted simultaneously as it happens. This ensures that there can be prompt response to the tampering of panels.

It should be appreciated that the detection module 17 can also be electrically connected to other sensors, such as, for example, infrared sensors, motion sensors, so that movement around the reinforced panel can be detected. Furthermore, the reinforced panel can also be coated with security film.

It should be noted that when panel 14 is made from tempered glass, the device 10 does not have to cover the entire panel 14 for the device 10 to function in the desired manner as cracks in tempered glass will propagate throughout the entire panel 14.

Figure 7:
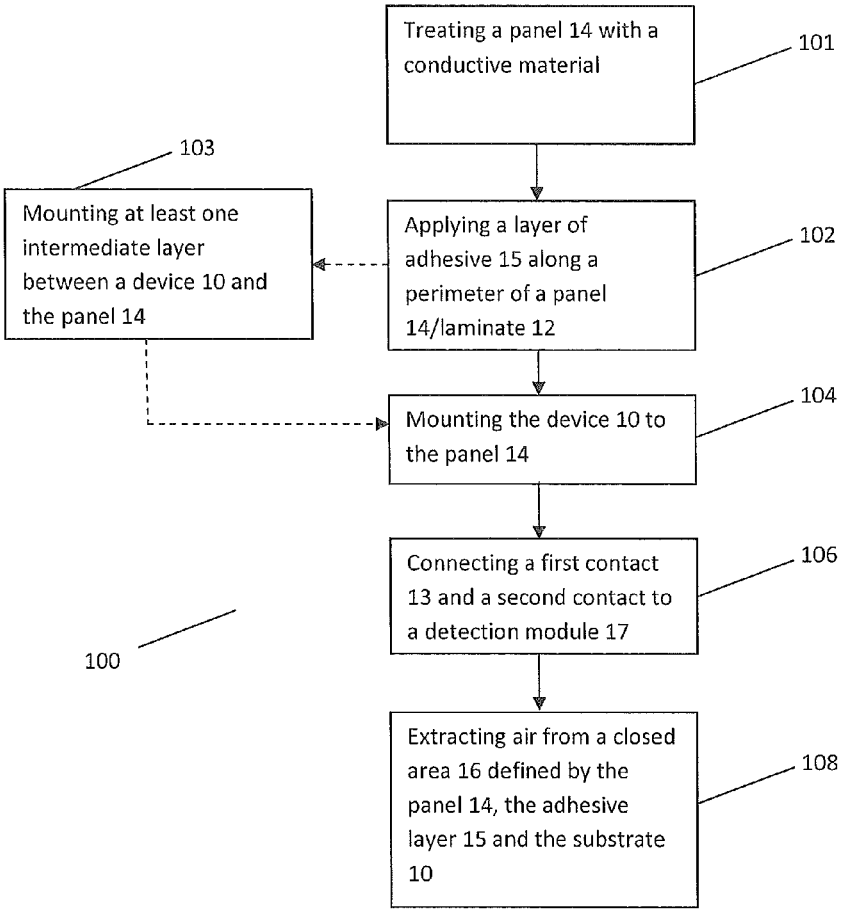
FIG. 7 shows a process flow chart indicating a first method for installing the device of the present invention to a panel.

Referring to FIG. 7, there is provided a method 100 for installing the device 10. The method 100 includes treating the panel 14 with a conductive material (101). However, this step can be avoided if multiple devices 10 are installed on the panel 14. The panel 14 can be treated with a material such as, for example, Indium Tin Oxide (ITO), AZO coated polymers (for example, PVB, PVC and PVE), and so forth. The treatment of the panel 14 can include processes such as, for example, physical vapor deposition, electron beam evaporation, various sputter deposition techniques and so forth. Then a layer of adhesive 15 is applied along a perimeter of the panel 14 or laminate 12 (102). The adhesive layer 15 can be applied by compressing a tube of adhesive, and the application in the circular manner is to minimise a number of voids in the adhesive layer 15 and to ensure that the adhesive layer 15 is able to provide a hermetic seal. The adhesive layer 15 can be covered by a waxed sheet to maintain adhesive properties of the adhesive layer 15. Alternatively, the adhesive layer 15 can also be formed using an adhesive sheet with a majority of a centre portion removed, leaving the adhesive layer 15 to form a seal.

The method 100 also includes mounting a device 10 to the panel 14 (104). Then the first contact lead 13 of the device 10 and the second contact lead 22 of the panel 14 are both electrically connected to the detection module 17 (106). Subsequently, air is extracted from the closed area 16 defined by the panel 14, the adhesive layer 15 and the device 10 (108). This causes the laminate 12 to contact the panel 14 and the second contact lead 22 comes into contact with the first contact 13. Subsequently, this forms a closed circuit with the detection module 17 (that is, electricity continuity is present). When the air is extracted, the laminate 12 is also configured to conform to the panel 14, and to move the first contact lead 13. In the method 100, it may also be possible to mount at least one intermediate layer between the device 10 and the panel 14 (103).

Figure 8:
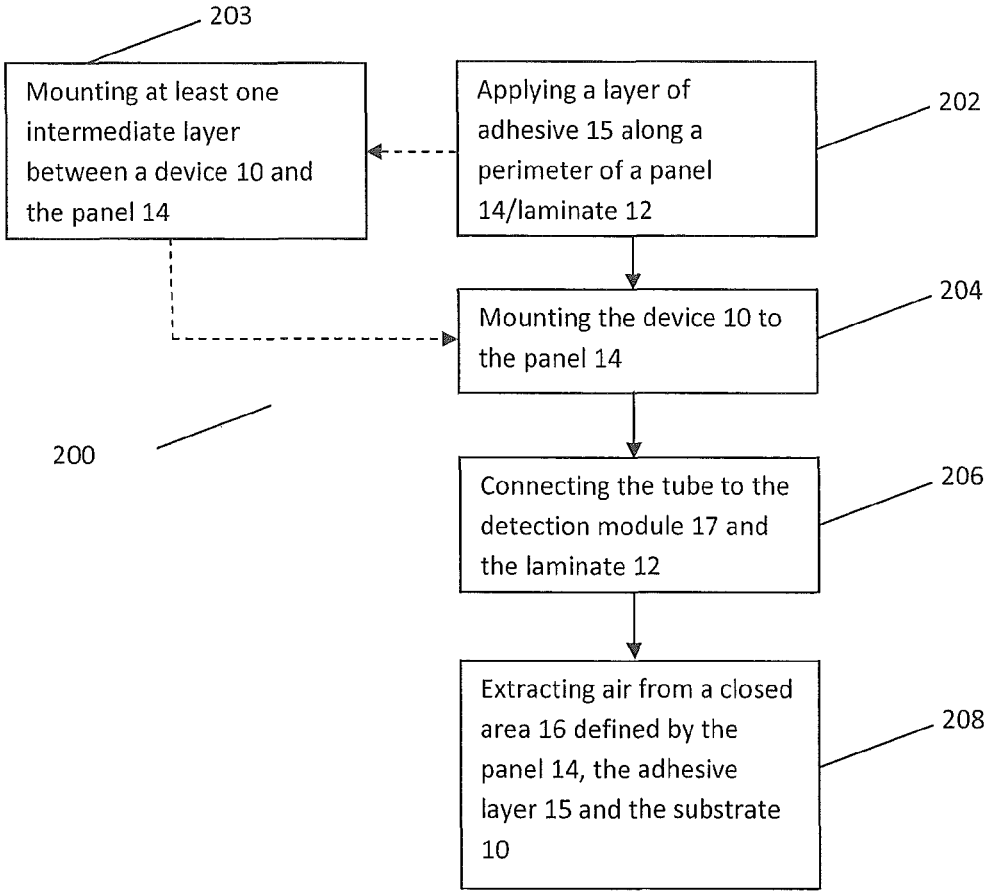
FIG. 8 shows a process flow chart indicating a second method for installing the device of the present invention to a panel.

Referring to FIG. 8, there is provided a method 200 for installing the device 10 where the pressure sensor (or transducer) is connected to the laminate 12 using a tube. A layer of adhesive 15 is applied along a perimeter of the panel 14 or laminate 12 (202). The adhesive layer 15 can be applied by compressing a tube of adhesive, and the application in the circular manner is to minimise a number of voids in the adhesive layer 15 and to ensure that the adhesive layer 15 is able to provide a hermetic seal. The adhesive layer 15 can be covered by a waxed sheet to maintain adhesive properties of the adhesive layer 15. Alternatively, the adhesive layer 15 can also be formed using an adhesive sheet with a majority of a centre portion removed, leaving the adhesive layer 15 to form a seal.

The method 100 also includes mounting a device 10 to the panel 14 (204). Then the tube is connected to both the detection module 17 and the laminate 12 (206). Subsequently, air is extracted from the closed area 16 defined by the panel 14, the adhesive layer 15 and the device 10 (208). When the air is extracted, the laminate 12 is configured to conform to the panel 14. In the method 200, it may also be possible to mount at least one intermediate layer between the device 10 and the panel 14 (203).

It should be appreciated that the method 100 ensures that device 10 is installed in a manner which allows the device 10 to function in the desired manner which provides the advantages as described earlier. Furthermore, the close contact of the laminate 12 with the panel 14 ensures that the panel 14 will have a compact profile after installation of the device 10.

As mentioned earlier, during instances when the panel 14 is made from tempered glass, it would not be necessary for the device 10 to entirely cover the panel 14. In this regard, the method 100 can also be changed in a manner whereby the device 10 does not entirely cover the panel 14.

Whilst there have been described in the foregoing description preferred embodiments of the present invention, it will be understood by those skilled in the technology concerned that many variations or modifications in details of design or construction may be made without departing from the present invention.

The invention claimed is:

1. A tamper detection device comprising:

a laminate;

a first contact lead attached to the laminate; and a detection module connected to the first contact lead, wherein, when in use, the laminate is configured to conform to an application surface and to move the first contact lead into contact with a second contact lead coupled to the application surface to form a closed circuit with the detection module.

2. The tamper detection device of claim 1, further including an adhesive layer along a perimeter of the laminate.

3. The tamper detection device of claim 2, wherein an opening defined within the adhesive layer is configured to be a sealable outlet.

4. The tamper detection device of claim 1, wherein the laminate is conductive.

5. The tamper detection device of claim 1, wherein the laminate is a piezoelectric sheet.

6. The tamper detection device of claim 1, wherein the detection module is wirelessly connected to the laminate.

7. The tamper detection device of claim 1, wherein the detection module is configured to detect pressure change.

8. The tamper detection device of claim 1, wherein the detection module includes at least one mechanism selected from a group consisting of: a strain gauge pressure sensor, an optical sensor, a contact-based sensor, and a voltage amplifier.

9. The tamper detection device of claim 1, wherein the laminate includes an opening, the opening being configured to fit a one-way valve for passage of air.

10. The tamper detection device of claim 1, further including at least one motion detection sensor electrically connected to the detection module.

11. A tamper detection device comprising:

a laminate; and a detection module connected to the laminate via a tube, the detection module including a pressure sensor, wherein, when in use, the laminate is configured to conform to an application surface and to activate the detection module in response to a change in pressure.

12. The tamper detection device of claim 11, further including an adhesive layer along a perimeter of the laminate.

13. The tamper detection device of claim 12, wherein an opening defined within the adhesive layer is configured to be a sealable outlet.

14. The tamper detection device of claim 11, wherein the laminate is conductive.

15. The tamper detection device of claim 11, wherein the laminate is a piezoelectric sheet.

16. The tamper detection device of claim 11, wherein the laminate includes an opening, the opening being configured to fit a one-way valve for passage of air.

17. The tamper detection device of claim 11, further including at least one motion detection sensor electrically connected to the detection module.

18. The tamper detection device of claim 1 being installed to a panel.

19. A method for installing the tamper detection device of claim 1 to a panel, the method comprising:

applying a layer of adhesive along a perimeter of one of the laminate of the tamper detection device and the panel;

mounting the tamper detection device to the panel;

connecting the first contact lead to the detection module; and extracting air from a closed area defined by the panel, the adhesive layer and the laminate, wherein the laminate is configured to conform to the panel and to move the first contact lead into contact with a second contact lead coupled to the panel to form a closed circuit with the detection module.

20. A method for installing the tamper detection device of claim 11 to a panel, the method comprising:

applying a layer of adhesive along a perimeter of the panel;

mounting the tamper detection device to the panel;

connecting the tube to the detection module and the laminate; and extracting air from a closed area defined by the panel, the adhesive layer and the laminate, wherein the laminate is configured to conform to the panel.

* * * * *